US006461124B1

(12) United States Patent
Morelli

(10) Patent No.: US 6,461,124 B1
(45) Date of Patent: Oct. 8, 2002

(54) THROUGH-FLOW BLOWER WITH COOLING FAN

(75) Inventor: Anthony J. Morelli, Alliance, OH (US)

(73) Assignee: Ametek, Inc., Kent, OH (US)

( * ) Notice: Subject to any disclaimer, the term of this patent is extended or adjusted under 35 U.S.C. 154(b) by 0 days.

(21) Appl. No.: 09/736,816

(22) Filed: Dec. 14, 2000

(51) Int. Cl.[7] ..... F04B 17/00; F04B 35/04

(52) U.S. Cl. ..... 417/423.8; 417/368; 417/423.14; 415/220

(58) Field of Search ..... 417/423.8, 423.5, 417/423.7, 423.24, 368, 370, 423.14, 423.2; 416/169 A, 175; 415/182.1, 220, 213.1, 214.1

(56) References Cited

U.S. PATENT DOCUMENTS

| | | | | |
|---|---|---|---|---|
| 2,294,586 | * | 9/1942 | Troller | 230/117 |
| 4,092,556 | * | 5/1978 | Mabuchi | 310/57 |
| 4,120,616 | * | 10/1978 | Dwyer et al. | 417/373 |
| 4,883,982 | * | 11/1989 | Forbes et al. | 310/62 |
| 5,217,353 | * | 6/1993 | De Filippis | 417/368 |
| 5,375,651 | * | 12/1994 | Colwell | 165/47 |
| 5,839,374 | * | 11/1998 | Conner et al. | 110/162 |
| 5,967,764 | * | 10/1999 | Booth et al. | 417/423.8 |
| 6,132,182 | * | 10/2000 | Khan et al. | 417/354 |
| 6,135,731 | * | 10/2000 | Woollenweber et al. | 417/423.14 |

FOREIGN PATENT DOCUMENTS

| | | | |
|---|---|---|---|
| JP | 7-035092 | * | 2/1995 |
| JP | 11-182498 | * | 7/1999 |

* cited by examiner

*Primary Examiner*—Charles G. Freay
*Assistant Examiner*—Han L. Liu
(74) *Attorney, Agent, or Firm*—Renner, Kenner, Greive, Bobak, Taylor & Weber

(57) ABSTRACT

A through-flow blower assembly includes a housing that carries a motor assembly. The motor assembly has a stator, and a rotor that rotates a shaft when energized. The rotor has openings therethrough. A fan shell has an axial opening and is coupled to the housing. At least one rotating fan is carried by the shaft. The rotating fan draws working air through said axial opening and exhausts the working air through an exhaust port of the housing. The rotating fan has a diameter larger than the rotor. A cooling fan is attached to the rotor and includes a fan disc and a fan ring. The fan disc is connected to the fan ring by a plurality of blades, said fan ring having an eye that is directly adjacent the rotor openings. The cooling fan has a diameter no larger than said rotor. As the rotor rotates, the cooling fan draws a portion of the working air over the motor assembly for cooling purposes. Stationary fans may be carried by the fan shell if more than one rotating fan is provided.

7 Claims, 3 Drawing Sheets

THROUGH-FLOW BLOWER WITH COOLING FAN

TECHNICAL FIELD

The invention herein resides generally in the art of through-flow blowers. More particularly, the present invention relates to a cooling fan that piggy backs the motor assembly included in the through-flow blower.

BACKGROUND ART

Through-flow blowers are generally known for drawing in air which is then re-oriented into another direction. These blowers typically draw the air through a series of interleaved motor-driven rotating fans and stationary fans to enhance the force of the air generated by the blower. This air may be used as working air such as with vacuum cleaners, furnace blowers or the like. The air, once drawn into the blower, typically swirls within the shell of a housing and is exhausted tangentially outwardly.

Currently internal turbulence within the attached motor housing, as a result of the internal features of the housing, is relied upon to dissipate the heat generated by the motor windings. Although this turbulence is effective in most instances for cooling the motor windings, in certain instances excessive heat is known to be generated. This excessive heat can lead to motor damage and related structural failures. In one application it has been found that the temperature between the windings and the ambient air can be as high as 96° C. Therefore, there is a need to facilitate/enhance the air flow over the motor windings for motors used in through-flow blowers.

DISCLOSURE OF INVENTION

In light of the foregoing, it is a first aspect of the present invention to provide a through-flow blower with a cooling fan.

Another aspect of the present invention is to provide a through-flow blower as set forth above, which couples a fan assembly to a motor.

Still a further aspect of the present invention is to provide a through-flow blower assembly, as set forth above, in which the motor is a brushless configuration having a stator assembly and a rotor assembly and wherein the rotor assembly has at least one opening therethrough.

Yet a further aspect of the present invention is to provide a through-flow blower, as set forth above, in which a cooling fan is coupled to the rotor assembly so as to draw cooling air through the opening and over the motor windings to dissipate heat in a more efficient manner.

Yet a further aspect of the present invention is to provide a through-flow blower, as set forth above, wherein the cooling fan has an outer diameter that is no larger than the outer diameter of the rotor.

The foregoing and other objects of the present invention, which shall become apparent as the detailed description proceeds, are achieved by a through-flow blower comprising; a working air fan assembly having an axial opening; a housing coupled to the working air fan assembly, the housing having an exhaust port; a motor assembly carried in the housing and rotating the working air fan assembly, the motor having a stator and a rotor, the rotor having at least one opening therethrough; and a cooling fan connected to the rotor, such that as the rotor rotates cooling air drawn through the opening.

Other aspects of the present invention are attained by a through-flow blower assembly comprising; a housing having a tangential exhaust port; a motor assembly carried by the housing, the motor assembly having a stator and a rotor, the rotor rotating a shaft when the motor assembly is energized, the rotor having openings therethrough; a fan shell having an axial opening; at least one rotating fan carried by the shaft, the at least one rotating fan drawing working air through the axial opening and exhausting the working air through the exhaust port, the at least one rotating fan having a diameter larger than the rotor; and a cooling fan having a fan disc and a fan ring, the fan disc connected to the fan ring by a plurality of blades, the fan ring having an eye that is directly adjacent the rotor openings, the cooling fan having a diameter no larger than the rotor.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 2:
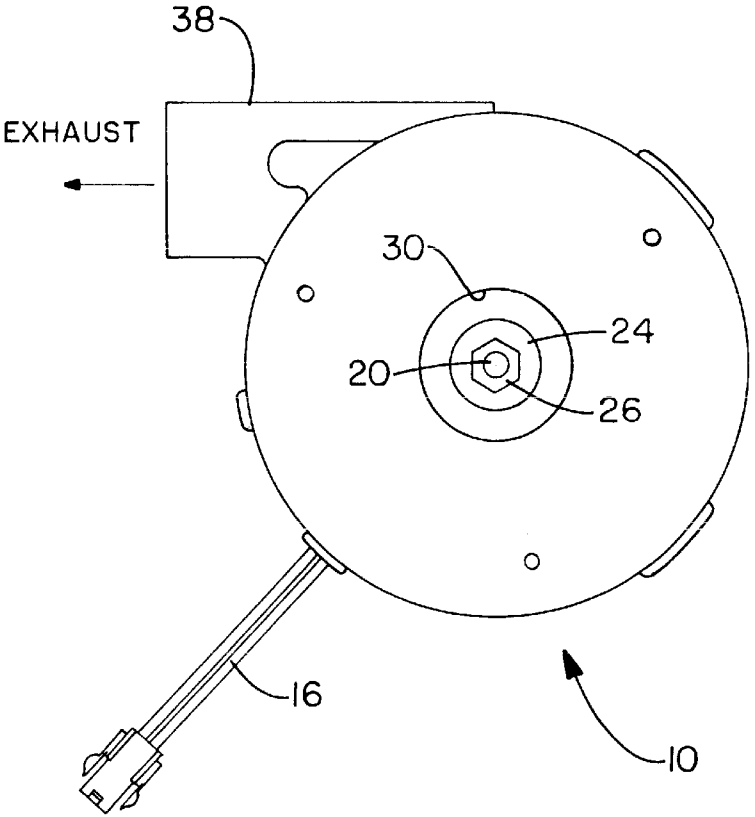
FIG. 2 is a frontal view of the through-flow blower.

Referring now to the drawings and more particularly to FIGS. 1–5, it can be seen that a through-flow blower with a cooling fan is designated generally by the numeral 10. Generally, the blower 10 includes a housing 12 which contains a motor assembly designated generally by the numeral 14. A pair of power leads 16 extend from the housing 12 to provide energy to the motor 14 from a power source (not shown). A shaft 20 is coupled to the motor assembly 14 in a manner well known in the art.

Figure 1:
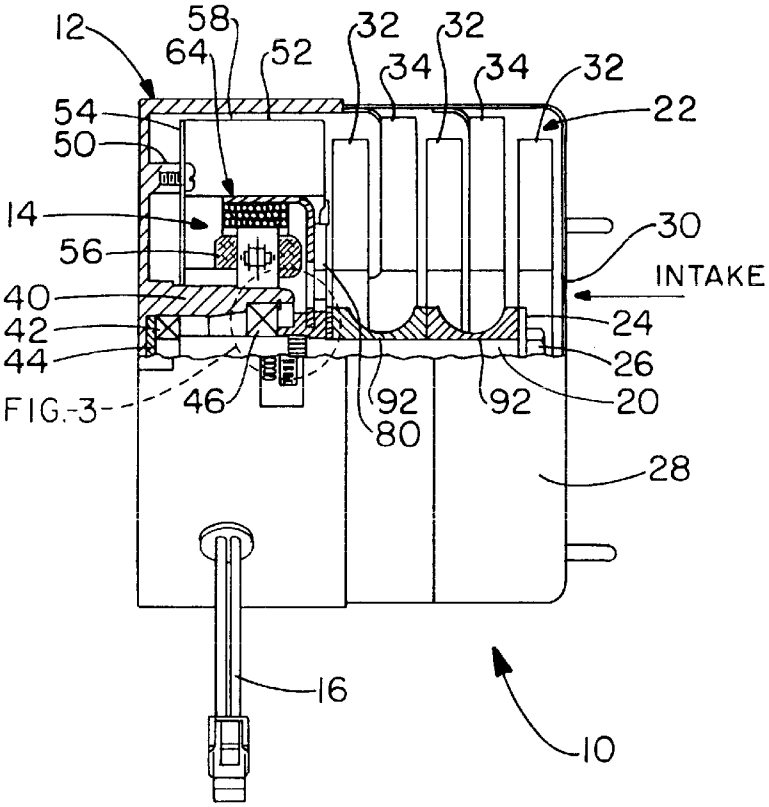
FIG. 1 is a side elevational view, in partial cross-section, of a through-flow blower according to the present invention.
Figure 3:
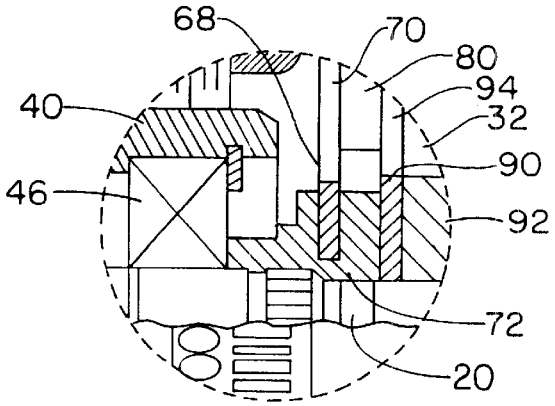
FIG. 3 is an enlarged view showing a cooling fan attached to a shaft of the through-flow blower.
Figure 4:
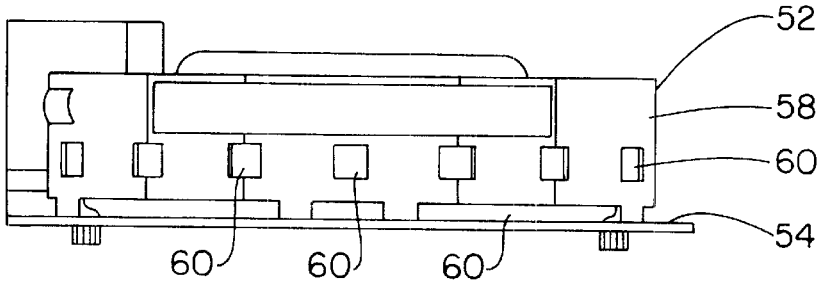
FIG. 4 is an elevational view of a stator assembly carried by the blower.
Figure 5:
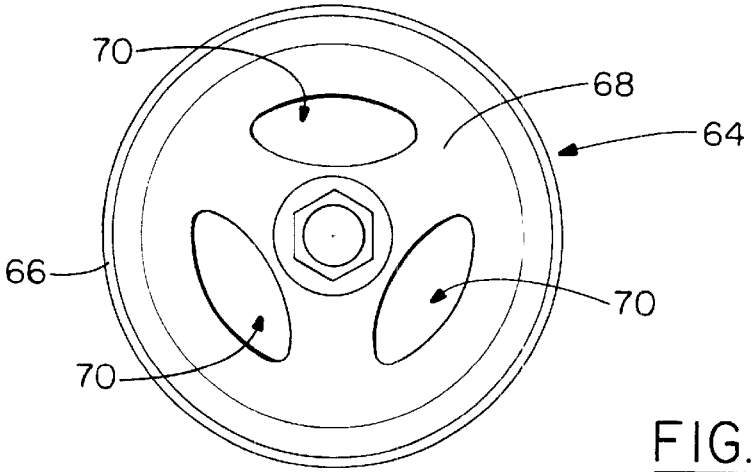
FIG. 5 is a plan view of a rotor assembly carried by the blower.

A fan assembly, designated generally by the numeral 22, is rotated by the shaft 20 and is connected thereto by a washer 24 and a nut 26. The fan assembly 22 includes a fan shell 28 which partially encloses the fan assembly and is secured to the housing 12 by press fit or appropriate fasteners. The fan shell 28 provides an axial opening 30 for drawing in working air and/or cooling air as needed. The fan assembly 22 includes at least one rotating fan 32 and in the preferred embodiment three rotating fans are employed. Interleaved between each rotating fan 32 is a stationary fan 34 that is carried by an interior surface of the fan shell 28 in a manner well known in the art. As the rotating fans 32 rotate, air is drawn in through the axial opening 30 and then radially dispersed by each fan. Upon exiting the vanes of rotating fans 32, the air becomes pressurized and is then forced through the stationary fan 34 to be received by the next-in-line rotating fan 32. It will be appreciated that any number of rotating fans 32 and stationary fans 34 may be used in a blower 10 as described herein. Typically, there will always be one less stationary fan than rotating fan. As shown in FIG. 1, there are three rotating fans and two stationary fans. If there is only one rotating fan, there is no need for a stationary fan.

The housing 12 includes a tangentially extending exhaust port 38 through which the working air is exhausted. The port 38 is at an end of the housing 12 opposite the end with the axial opening. It will be appreciated that as the working air exits the rotating fan 32 furthest from the axial opening 30, the air swirls around within the housing and once pressurized exits the exhaust port 38. The housing 12 includes an axially extending hub 40 which extends in a direction toward the fan assembly 22. The hub 40 includes an end bearing 42 which rotatably receives one end of the shaft 20 in a manner well known in the art. A washer 44 may be interposed between the bearing 42 and the housing 12. A fan end bearing 46 is carried in a distal end of the hub 40, away from the housing 12, to provide a second point of rotatable contact with the shaft. A plurality of internal stand-offs 50 are provided about the periphery of the housing 12 to support and carry a stator assembly 52. The stator assembly 52 includes a stator plate 54 which carries circuitry and related connections between the leads 16 and of the stator windings 56. Extending from the stator plate 54 is a stator sidewall 58 which has a plurality of openings 60.

A rotor assembly 64, which is secured to the shaft 20 and which causes the shaft to rotate when the windings are energized, is rotatably received within the stator assembly 52. The rotor assembly includes a sidewall 66 which is partially enclosed at one end thereof by an end wall 68. The end wall 68 includes at least one opening 70. A coupling 72 secures the rotor assembly 64 to the shaft 20.

Figure 7:
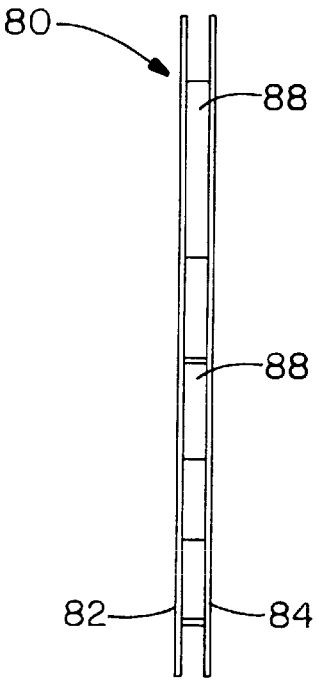
FIG. 7 is an edge view of the cooling fan.
Figure 6:
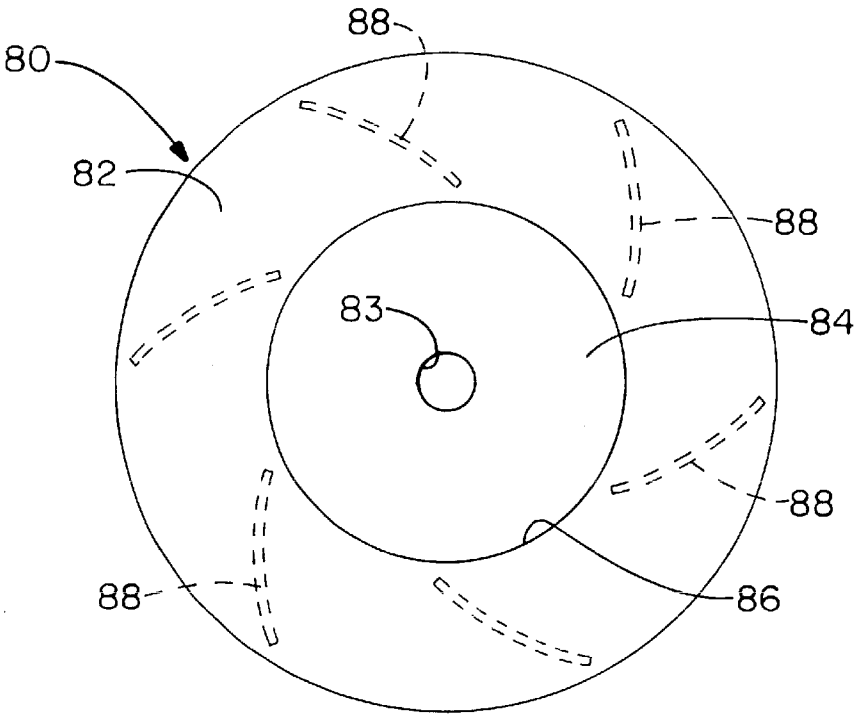
FIG. 6 is a plan view of a cooling fan.

A cooling fan, designated generally by the numeral 80, is carried by the shaft 20 and is positioned adjacent to the end wall 68. As best seen in FIGS. 6 and 7, the cooling fan includes a fan disc 82, which has a shaft hole 83, and a fan ring 84 which has an eyelet 86. Interconnecting the fan disc 82 to the fan ring 84 are a plurality of curvilinear vanes 88. The cooling fan 80 is positioned so that the fan ring 84 is aligned directly adjacent the rotor end wall 68. Accordingly, the eyelet 86 is directly aligned with at least a portion of the openings 70. A cooling fan spacer 90 is interposed between the fan disc 82 and the next adjacent rotating fan 32. Working fans spacers 92 are radially positioned between the rotating fans and stationary fans 32, 34 and the shaft 20. Accordingly, a gap 94 is formed by the spacer 90 between the cooling fan 80 and the most adjacent rotating fan 32.

In operation, when the motor assembly 14 is energized, rotation of the rotor 64 and the shaft 20 is initiated. Rotation of the shaft turns the rotating fans 32 so as to draw working air in through the axial opening 30. This working air is then expelled by the rotating fans radially whereupon it is dispersed by the stationary fans 34. It is then received by the next adjacent rotating fan 32 and the above process is repeated until the working air is expelled out the exhaust port 38. In the past, this working air had been relied upon to provide cooling airflow near but not directly over, the motor windings and allow for dissipation of heat generated thereby. To significantly improve the cooling of the motor windings, inclusion of the cooling fan 80 functions to draw cooling air directly over the motor windings so as to dissipate heat. In particular, the rotation of the rotor and the attached cooling fan 80 draws in a portion of the working air before it is exhausted out the port 38 and then recirculates air in an axial direction essentially opposite that of the working air flow. This air is then pulled directly over the windings. When this cooling air is expelled from the fan 80, it is exhausted by the vanes 88 so as to mix with the working air flow so that it can be exhausted through the exhaust port 38.

The advantages of the present invention are readily apparent based upon the foregoing description. In particular, use of the cooling fan coupled to the rotor functions to pull air through and over the motor windings so as to dissipate and remove heat generated thereby. The cooling air is expelled out from the cooling fan to mix with the working air flow. This is accomplished by coupling the cooling fan to the rotor so as to redirect the air flow from an axial direction to a radial direction. Moreover, the outer diameter of the cooling fan is such that it does not interfere with operation of the blower or require excessive work to be performed by the motor. Moreover, the outer diameter of the cooling fan is smaller in diameter than the rotating fans 32 or the rotor 64 so that the primary flow of the working air is not impeded. Inclusion of the cooling fan with the blower referred to in the Background Art reduces the difference between the ambient temperature and winding temperature from about 96° C. to about 53° C.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of true scope and breadth of the invention, reference should be made to the following claims.

What is claimed is:

1. A through-flow blower comprising;

a working air fan assembly having an axial opening;

a housing coupled to said working air fan assembly, said housing having an exhaust port;

a motor assembly carried in said housing and rotating said working air fan assembly, said motor having a stator and a rotor, said rotor having at least one opening therethrough; and a cooling fan connected to said rotor, such that as said rotor rotates cooling air is drawn through said opening, wherein said cooling fan has an outer diameter that is less than an outer diameter of said rotor.

2. The blower according to claim 1, further comprising;

a shaft coupled to said rotor, said working air fan assembly and said cooling fan.

3. The blower according to claim 1, wherein said cooling fan comprises;

a fan disc having a shaft opening;

a fan ring having an eyelet; and a plurality of fan blades connecting said fan disc to said fan ring, said eyelet positioned adjacent said rotor opening.

4. The blower according to claim 3, wherein said rotor comprises;

an end wall having said rotor opening; and a side wall extending from said end wall.

5. A through-flow blower assembly comprising;

a housing having a tangential exhaust port;

a motor assembly carried by said housing, said motor assembly having a stator and a rotor, said rotor rotating a shaft when said motor assembly is energized, said rotor having openings therethrough;

a fan shell having an axial opening;

at least one rotating fan carried by said shaft, said at least one rotating fan drawing working air through said axial opening and exhausting the working air through said exhaust port, said at least one rotating fan having a diameter larger than said rotor; and a cooling fan having a fan disc and a fan ring, said fan disc connected to said fan ring by a plurality of blades, said fan ring having an eye that is directly adjacent said rotor openings, said cooling fan having a diameter no larger than said rotor.

6. The assembly according to claim 5, further comprising:

a plurality of rotating fans carried by said shaft; and a predetermined number of stationary fans carried by said fan shell, wherein said predetermined number is one less than the number of said plurality of rotating fans.

7. The assembly according to claim 6, wherein said stationary fans are interleaved between said rotating fans.

* * * * *